US011061348B2

(12) United States Patent
Tanaka et al.

(10) Patent No.: US 11,061,348 B2
(45) Date of Patent: Jul. 13, 2021

(54) IMAGE FORMING APPARATUS

(71) Applicant: FUJIFILM Business Innovation Corp., Tokyo (JP)

(72) Inventors: Satoshi Tanaka, Kanagawa (JP); Chihiro Hagiwara, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/793,819

(22) Filed: Feb. 18, 2020

(65) Prior Publication Data

US 2020/0310305 A1 Oct. 1, 2020

Related U.S. Application Data

(63) Continuation of application No. 16/511,655, filed on Jul. 15, 2019, now Pat. No. 10,599,075.

(30) Foreign Application Priority Data

Mar. 25, 2019 (JP) ..... 2019-057081

(51) Int. Cl.

| | |
|---|---|
| ***G03G 15/10*** | (2006.01) |
| ***G03G 15/16*** | (2006.01) |
| ***G03G 15/01*** | (2006.01) |
| ***G03G 21/14*** | (2006.01) |

(52) U.S. Cl.

CPC ..... *G03G 15/1615* (2013.01); *G03G 15/0131* (2013.01); *G03G 15/0184* (2013.01); *G03G 21/14* (2013.01); *G03G 2215/00021* (2013.01); *G03G 2215/00042* (2013.01); *G03G 2215/00059* (2013.01); *G03G 2215/00548* (2013.01); *G03G 2215/00561* (2013.01); *G03G 2215/0158* (2013.01)

(58) Field of Classification Search

CPC ..... G03G 15/1615; G03G 15/0131; G03G 15/0184; G03G 21/14; G03G 2215/00021; G03G 2215/2215; G03G 2215/00561; G03G 2215/00599; G03G 2215/0158; G03G 2215/00042; G03G 2215/00059; G03G 2215/00548

See application file for complete search history.

(56) References Cited

U.S. PATENT DOCUMENTS

| | | | | |
|---|---|---|---|---|
| 8,594,543 | B2 | 11/2013 | Krucinski | |
| 8,682,233 | B2 | 3/2014 | Dejong et al. | |
| 8,731,447 | B2 * | 5/2014 | Krucinski | G03G 15/1615 399/299 |
| 2011/0076045 | A1 | 3/2011 | Sobue | |
| 2014/0072315 | A1 * | 3/2014 | Ohmiya | G03G 15/0131 399/49 |

FOREIGN PATENT DOCUMENTS

| | | | |
|---|---|---|---|
| JP | 2003-186256 | A | 7/2003 |

* cited by examiner

*Primary Examiner* — Hoang X Ngo
(74) *Attorney, Agent, or Firm* — Sughrue Mion, PLLC

(57) ABSTRACT

An image forming apparatus includes a first plurality of image forming sections that form a first toner image for adjustment and transfer the first toner image for adjustment to a medium; a second plurality of image forming sections that form a second toner image for adjustment and transfer the second toner image for adjustment to the medium; and a detection device configured to detect a misregistration between the first toner image for adjustment transferred to the medium and the second toner image for adjustment transferred to the medium.

2 Claims, 6 Drawing Sheets

IMAGE FORMING APPARATUS

CROSS-REFERENCE TO RELATED APPLICATIONS

This application is a continuation of U.S. patent application Ser. No. 16/511,655 filed Jul. 15, 2019, which is based on and claims priority under 35 USC 119 from Japanese Patent Application No. 2019-057081 filed Mar. 25, 2019, the contents of which are incorporated herein by reference in their entirety.

BACKGROUND

(i) Technical Field

The present disclosure relates to an image forming apparatus.

(ii) Related Art

Japanese Unexamined Patent Application Publication No. 2003-186256 discloses a multi-color image forming device for an electrophotographic device, in which a plurality of recording devices are disposed on both surfaces of a recording medium to allow multi-layer transfer of images in a plurality of colors to both surfaces of the same recording medium.

U.S. Pat. No. 8,682,233 discloses an image forming device in which two units that each include four marking stations are disposed on a paper transport belt.

SUMMARY

Aspects of non-limiting embodiments of the present disclosure relate to providing an image forming apparatus that includes a plurality of image forming units that each include a first intermediate transfer body to which toner images formed by a plurality of image forming sections are transferred through a first transfer, in which the toner images on the first intermediate transfer bodies of the plurality of image forming units are transferred to a transfer target body through second transfer, the image forming apparatus detecting the toner images which have passed through all the second transfer sections.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided an image forming apparatus including: a plurality of image forming units that each include a plurality of image forming sections and a first intermediate transfer body to which toner images formed by the plurality of image forming sections are transferred through first transfer; a plurality of second transfer sections provided in correspondence with the plurality of image forming units to transfer the toner images on the first intermediate transfer body to a recording medium through second transfer; and a detection device that detects the toner images downstream of a most downstream one of the second transfer sections.

BRIEF DESCRIPTION OF THE DRAWINGS

An exemplary embodiment of the present disclosure will be described in detail based on the following figures, wherein.

DETAILED DESCRIPTION

Exemplary Embodiment

Figure 1:
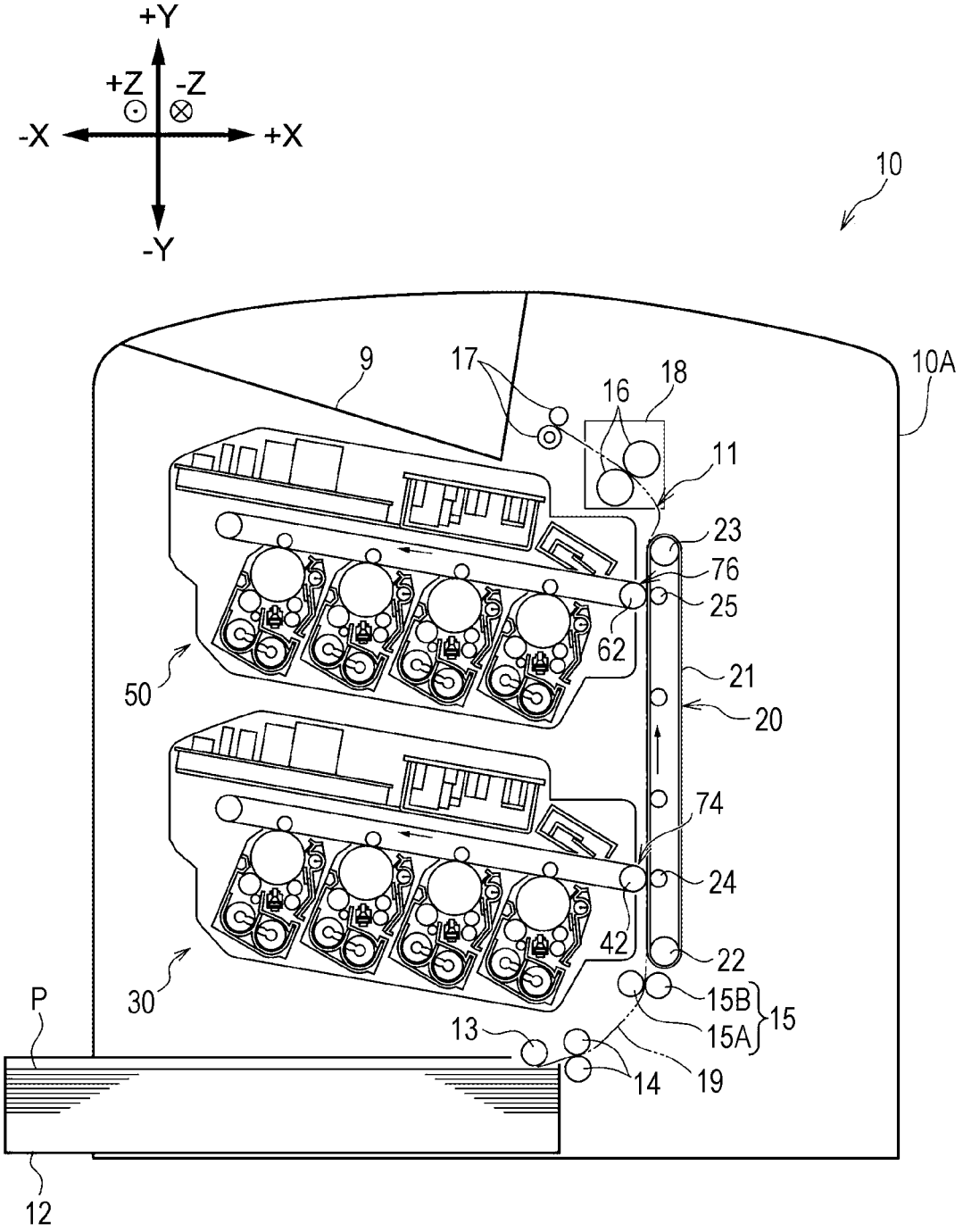
FIG. 1 illustrates the configuration of an image forming apparatus according to an exemplary embodiment.

An image forming apparatus according to an exemplary embodiment of the present disclosure will be described. The width direction, the height direction, and the depth direction of an image forming apparatus 10 illustrated in FIG. 1 are defined as X direction, Y direction, and Z direction and indicated by arrows X, Y, and Z, respectively. In the case where it is necessary to distinguish one side and the other side in the X direction, the Y direction, and the Z direction, the right side and the left side of the image forming apparatus 10 illustrated in FIG. 1 are referred to as +X side and −X side, the upper side and the lower side of the image forming apparatus 10 are referred to as +Y side and −Y side, and the front side and the rear side of the image forming apparatus 10 are referred to as +Z side and −Z side, respectively. In the present exemplary embodiment, recording paper P is adopted as an example of a recording medium. The upstream side in the transport direction, in which the recording paper P is transported, is referred to as a "transport-direction upstream side", and the downstream side in the transport direction is referred to as a "transport-direction downstream side". The image forming apparatus 10 according to the present exemplary embodiment is of a so-called single pass type, in which the recording paper P passes before an image forming unit 30 and an image forming unit 50 to be discussed later once each to perform printing.

[Overall Configuration]

First, the overall configuration of the image forming apparatus will be described.

As illustrated in FIG. 1, the image forming apparatus 10 includes a housing section 12 that houses the recording paper P, a transport section 11 that transports the recording paper P along a transport path 19, and the image forming unit 30 and the image forming unit 50 which form toner images to be transferred to the recording paper P.

The housing section 12 is drawable from an image forming apparatus body 10A which is the apparatus body of the image forming apparatus 10, and houses the recording paper P.

The transport section 11 includes a feed roller 13, a transport roller 14, a resist roller pair 15, a transport belt device 20, a fixing device 18, and an ejection roller 17, which are arranged in this order from the transport-direction upstream side, etc.

The feed roller 13 feeds the recording paper P, which is housed in the housing section 12, to the transport path 19, which constitutes the transport section 11. The transport roller 14 transports the recording paper P along the transport path 19.

The resist roller pair 15 transports the recording paper P, which is transported by the transport roller 14, to a second transfer position TJ2 on the upstream side to be discussed later. In the resist roller pair 15, a pinch roller 15B follows a resist roller 15A to rotate. The resist roller pair 15 transports the recording paper P toward the transport-direction downstream side with the recording paper P interposed between the resist roller 15A and the pinch roller 15B.

The transport belt device 20 transports the recording paper P toward the transport-direction downstream side along the transport path 19 while transferring the toner images, which are formed by the image forming units 30 and 50, to the recording paper P. The transport belt device 20 will be discussed in detail later.

The fixing device 18 includes a fixing roller pair 16, and heats and pressurizes the recording paper P, to which the toner images have been transferred, as the recording paper P passes between the fixing roller pair 16 to fix the toner images to the recording paper P.

The ejection roller 17 ejects the recording paper P, to which the toner images have been fixed by the fixing device 18, to an ejection section 9.

The image forming unit 30 and the image forming unit 50 are disposed side by side in the vertical direction. In the present exemplary embodiment, the image forming unit 50 is disposed above the image forming unit 30. When described from a different point of view, the image forming unit 50 is disposed on the transport-direction downstream side of the image forming unit 30.

Figure 2:
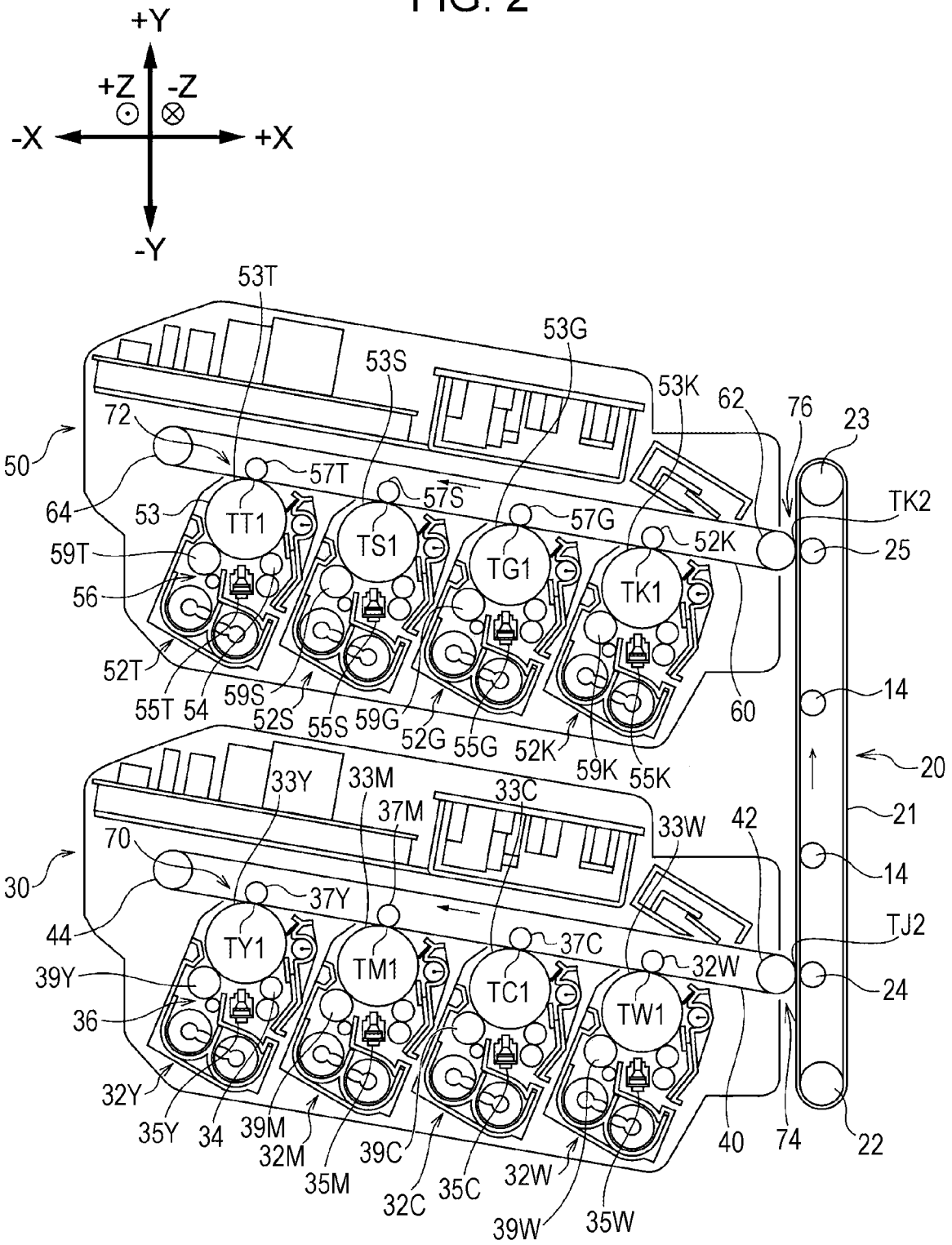
FIG. 2 is a partial enlarged view of FIG. 1.

As illustrated in FIG. 2, the image forming unit 30 includes four image forming sections 32 and an endless intermediate transfer belt 40. The intermediate transfer belt 40 is configured such that toner images formed by the four image forming sections 32 are transferred thereto, and mounted so as to be rotatable counterclockwise when FIG. 2 is viewed from the front.

The image forming sections 32 include an image forming section 32W that forms a white toner image in white color, an image forming section 32M that forms a magenta toner image in magenta color, an image forming section 32C that forms a cyan toner image in cyan color, and an image forming section 32Y that forms a yellow toner image in yellow color. The four image forming sections 32 are disposed in the order of the image forming section 32Y, the image forming section 32M, the image forming section 32C, and the image forming section 32W from the upstream side in the rotational direction in which the intermediate transfer belt 40 is rotated (from the side close to a support roller 44 to be discussed later). Hereinafter, the upstream side in the rotational direction of the intermediate transfer belt 40 will be referred to as a "rotational-direction upstream side", and the downstream side in the rotational direction thereof will be referred to as a "rotational-direction downstream side". That is, among the image forming sections 32, the image forming section 32W is disposed on the most downstream side in the rotational direction.

In the case where there is no need to differentiate among Y, M, C, and W, such symbols are omitted.

The image forming section 32 includes a photosensitive body 33, a charging member 34 that charges the surface of the photosensitive body 33, an exposure device 35 that radiates light to the photosensitive body 33 which has been charged, and a developing device 36 that develops an electrostatic latent image formed by the light radiation to be visualized as a toner image.

Figure 3:
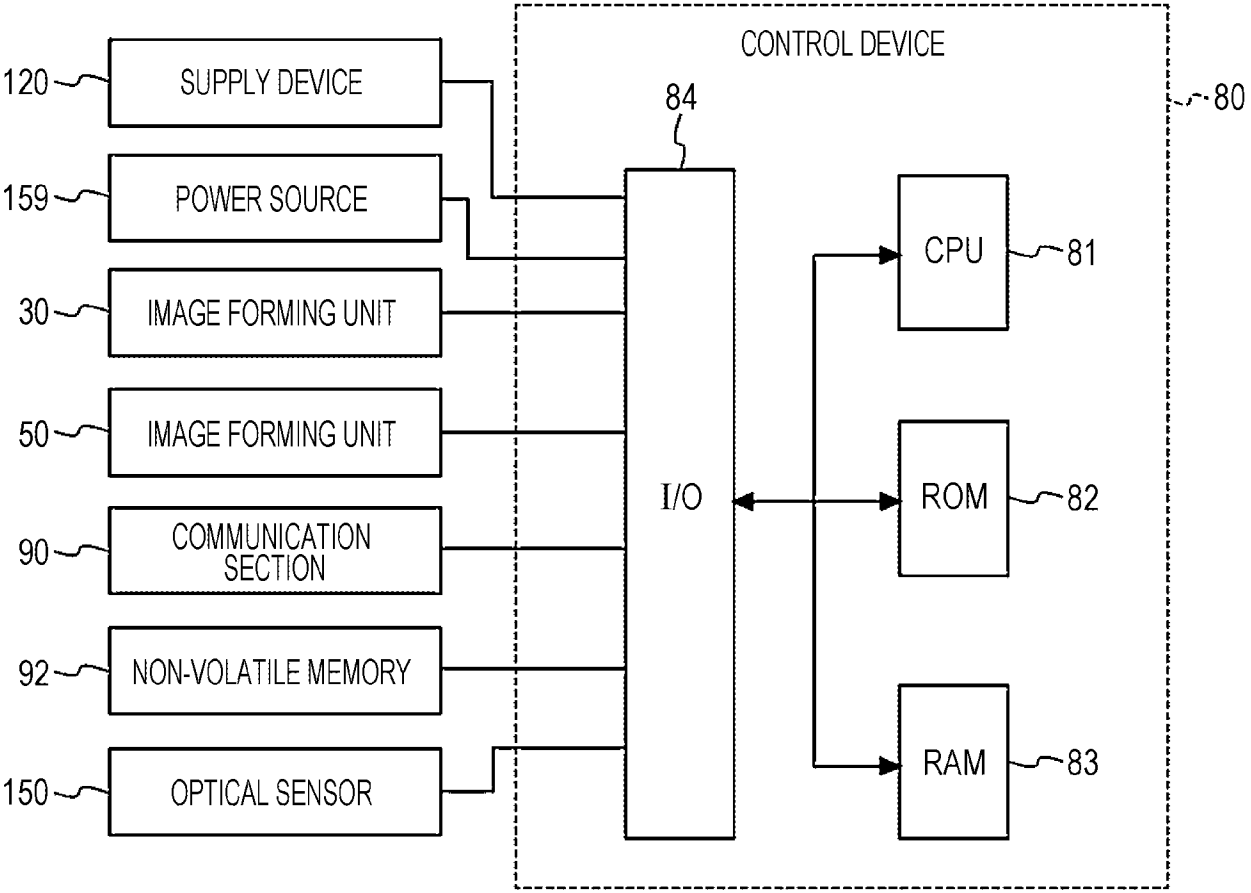
FIG. 3 is a block diagram illustrating the configuration of a control device etc. according to the present exemplary embodiment.

The developing device 36 includes developing rollers 39Y, 39M, 39C, and 39W, to which developing biases are applied by a power source device 159 (see FIG. 3).

First transfer rollers 37Y, 37M, 37C, and 37W are disposed at positions facing the photosensitive bodies 33 with the intermediate transfer belt 40 interposed therebetween. The first transfer rollers 37Y, 37M, 37C, and 37W transfer the toner images which are formed by the image forming sections 32 to the intermediate transfer belt 40. The intermediate transfer belt 40 is wound around the support roller 44, which supports the intermediate transfer belt 40, and a back-up roller 42 disposed at a second transfer section 74 on the upstream side to be discussed later. A first transfer section 70 is constituted to include the photosensitive body 33, the first transfer roller 37, and the intermediate transfer belt 40. Positions between the photosensitive bodies 33Y, 33M, 33C, and 33W and the intermediate transfer belt 40 are defined as first transfer positions TY1, TM1, TC1, and TW1, respectively.

The image forming unit 50 is configured similarly to the image forming unit 30 discussed earlier except for the colors of images to be formed. The image forming unit 50 includes four image forming sections 52 and an intermediate transfer belt 60. The intermediate transfer belt 60 is configured such that toner images formed by the four image forming sections 52 are transferred thereto, and mounted so as to be rotatable counterclockwise when FIG. 2 is viewed from the front.

The image forming sections 52 are configured similarly to the image forming sections 32 of the image forming unit 30 except for the colors of images to be formed. The intermediate transfer belt 60 and first transfer rollers 57 to be discussed later are also configured similarly to the intermediate transfer belt 40 and the first transfer rollers 37, respectively, of the image forming unit 30. Other constituent members that constitute the image forming unit 50 are also similar to those of the image forming unit 30.

The image forming sections 52 include an image forming section 52K that forms a black toner image in black color, an image forming section 52G that forms a gold toner image in gold color, an image forming section 52S that forms a silver toner image in silver color, and an image forming section 52T that forms a transparent toner image in transparent color. The four image forming sections 52 are disposed in the order of the image forming section 52T, the image forming section 52S, the image forming section 52G, and the image forming section 52K from the rotational-direction upstream side (from the side close to a support roller 64 to be discussed later). That is, among the image forming sections 52, the image forming section 52K is disposed on the most downstream side in the rotational direction, the image forming section 52G and the image forming section 52S are disposed on the rotational-direction upstream side with respect to the image forming section 52K, and the image forming section 52T disposed on the most upstream side in the rotational direction.

In the case where there is no need to differentiate among T, S, G, and K, such symbols are omitted.

The image forming section 52 includes a photosensitive body 53, a charging member 54, an exposure device 55, and a developing device 56.

The developing device 56 includes developing rollers 59T, 59S, 59G, and 59K, to which developing biases are applied by the power source device 159 (see FIG. 3).

First transfer rollers 57T, 57S, 57G, and 57K are disposed at positions facing the photosensitive bodies 53 with the intermediate transfer belt 60 interposed therebetween. The intermediate transfer belt 60 is wound around the support roller 64 and a back-up roller 62 disposed at a second transfer section 76 on the downstream side to be discussed later. A first transfer section 72 is constituted to include the photosensitive body 53, the first transfer roller 57, and the intermediate transfer belt 60. Positions between the photosensitive bodies 53T, 53S, 53G, and 53K and the intermediate transfer belt 60 are defined as first transfer positions TT1, TS1, TG1, and TK1, respectively.

Figure 4:
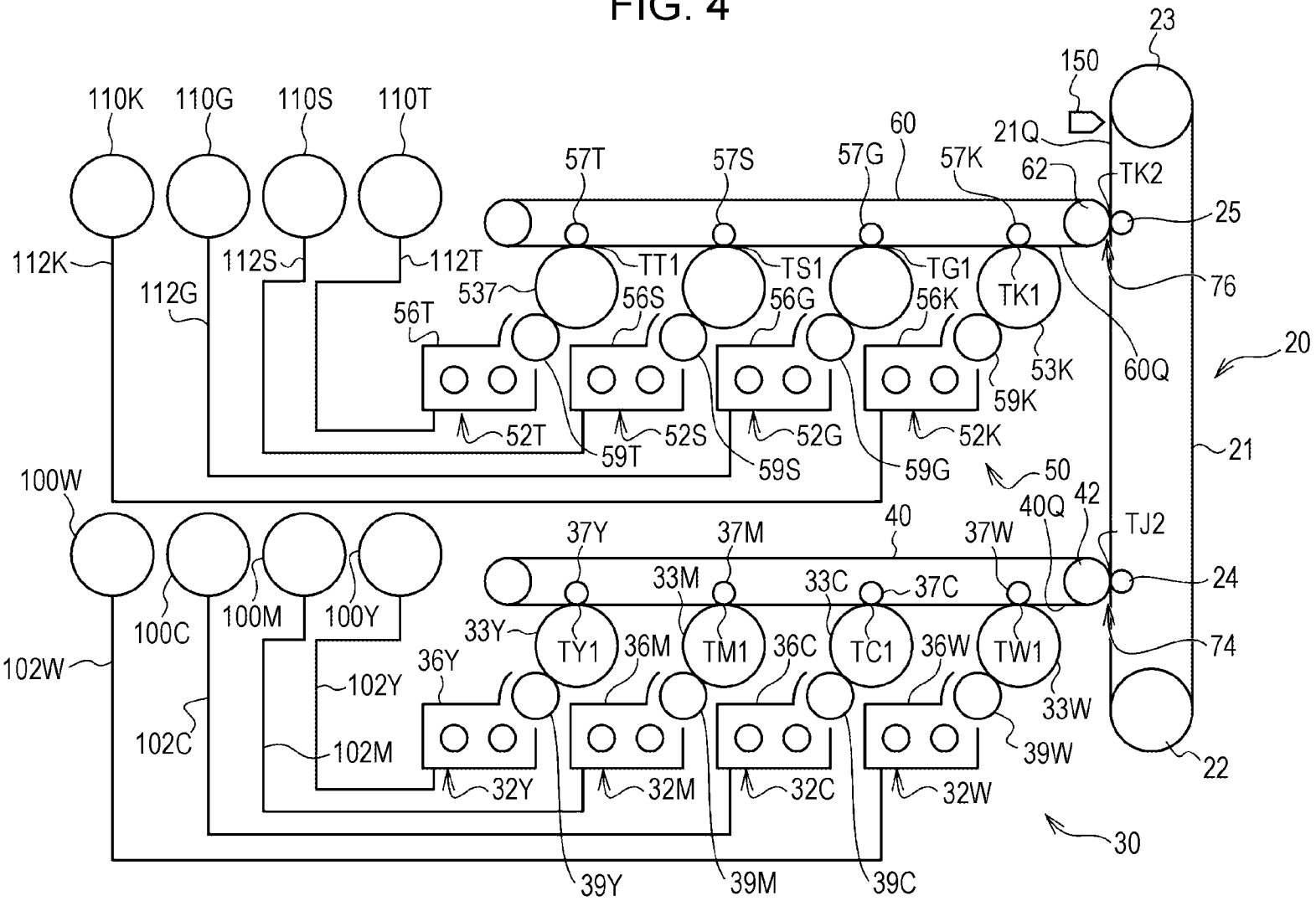
FIG. 4 is a schematic diagram schematically illustrating the configuration of the image forming apparatus according to the exemplary embodiment.

As illustrated in FIG. 4, a plurality of toner cartridges 100 and 110 that contain toners in the corresponding colors are coupled to the developing devices 36 of the image forming sections 32 for the respective colors of the image forming unit 30 and the developing devices 56 of the image forming sections 52 for the respective colors of the image forming unit 50 via supply paths 102 and 112. The toners which are contained in the toner cartridges 100 and 110 are supplied, as appropriate, to the developing devices 36 and 56 for the respective colors via the supply paths 102 and 112 when a supply device 120 (see FIG. 3) provided to the supply paths 102 and 112 is actuated. The supply device 120 (see FIG. 3) is capable of individually supplying the toners from toner cartridges 100Y, 100M, 100C, 100W, 110T, 110S, 110G, and 110K to developing devices 36Y, 36M, 36C, 36W, 56T, 56S, 56G, and 56K, respectively.

Next, the transport belt device 20 will be described in detail.

As illustrated in FIG. 2, the transport belt device 20 includes an endless transport belt 21, support rollers 22 and 23 that support the transport belt 21, the transport roller 14, and second transfer rollers 24 and 25 respectively disposed at positions facing the back-up rollers 42 and 62 with the intermediate transfer belts 40 and 60 interposed therebetween.

The second transfer roller 24 transfers the toner images, which are formed on the intermediate transfer belt 40 of the image forming unit 30, to the recording paper P with the recording paper P and the transport belt 21 interposed between the back-up roller 42 and the second transfer roller 24. Similarly, the second transfer roller 25 transfers the toner images, which are formed on the intermediate transfer belt 60 of the image forming unit 50, to the recording paper P with the recording paper P and the transport belt 21 interposed between the back-up roller 62 and the second transfer roller 25.

The second transfer section 74 is constituted to include the back-up roller 42, the second transfer roller 24, and the intermediate transfer belt 40. The second transfer section 76 is constituted to include the back-up roller 62, the second transfer roller 25, and the intermediate transfer belt 60.

A transfer bias is applied to the second transfer rollers 24 and 25 by the power source device 159 (see FIG. 3).

A position between the intermediate transfer belt 40 of the image forming unit 30 and the transport belt 21 is defined as the second transfer position TJ2. A position between the intermediate transfer belt 60 of the image forming unit 50 and the transport belt 21 is defined as a second transfer position TK2. The second transfer position TK2 is the most downstream second transfer position.

The transport belt device 20 includes a belt cleaning device (not illustrated) that cleans the transport belt 21. The belt cleaning device (not illustrated) performs cleaning on the rotational-direction upstream side of the most downstream second transfer position TK2 and on the rotational-direction downstream side of the most upstream second transfer position TJ2. A position at which the transport belt 21 is cleaned by the belt cleaning device (not illustrated) is defined as a cleaning position CL.

Figure 5A:
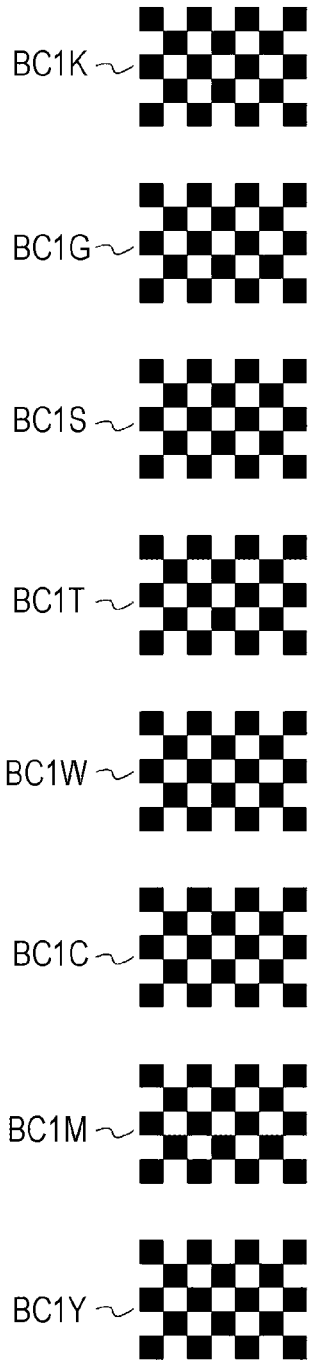
FIG. 5A illustrates first patch images for toner supply adjustment.

The image forming sections 32 of the image forming unit 30 and the image forming sections 52 of the image forming unit 50 form first patch images BC1 (see FIG. 5A) for toner supply adjustment, second patch images BC2 (see FIG. 5B) for concentration adjustment, and third patch images BC3 (see FIG. 5C) for misregistration adjustment using the toners in the respective colors. Symbols Y, M, C, W, T, S, G, and K that follow the first patch images BC1, the second patch images BC2, and the third patch images BC3 represent the colors of the toners, and are omitted in the case where there is no need to differentiate among such colors.

In the present exemplary embodiment, the first patch images BC1 (see FIG. 5A) for toner supply adjustment, the second patch images BC2 (see FIG. 5B) for concentration adjustment, and the third patch images BC3 (see FIG. 5C) for misregistration adjustment are formed on the intermediate transfer belts 40 and 60, and finally transferred to the transport belt 21 through a second transfer. The first patch images BC1 (see FIG. 5A) for toner supply adjustment, the second patch images BC2 (see FIG. 5B) for concentration adjustment, and the third patch images BC3 (see FIG. 5C) for misregistration adjustment will be simply referred to as "patch images BC" in the case where there is no need to differentiate among such patch images.

As illustrated in FIG. 4, a sensor 150 is provided in the vicinity of the upper end portion of the transport belt 21 as an example of a detection device that detects the patch images BC which have been transferred to the transport belt 21 through the second transfer. The optical sensor 150 detects the patch images BC at a flat portion 21Q on the downstream side with respect to the most downstream second transfer position TK2 and between the second transfer position TK2 and the support roller 23 on the upper side around which the transport belt 21 is wound. In the present exemplary embodiment, the optical sensor 150 detects the patch images BC at the flat portion 21Q in the vicinity of the support roller 23. Alternatively, the optical sensor 150 may detect the patch images BC at a position overlapping the support roller 23 as seen through in a horizontal direction that is orthogonal to the axial direction.

The optical sensor 150 is disposed at a position on the downstream side with respect to the most downstream second transfer section 76 and at which the patch images BC are detectable. When described from a different point of view, the optical sensor 150 is disposed at a position at which all the patch images BC formed by all the image forming sections 32Y, 32M, 32C, 32W, 52T, 52S, 52G, and 52K are detectable.

In the present exemplary embodiment, the optical sensor 150 may be disposed at a position on the rotational-direction upstream side of the most downstream second transfer position TK2, on the rotational-direction upstream side of the cleaning position CL, and at which the patch images BC are detectable.

Figure 6:
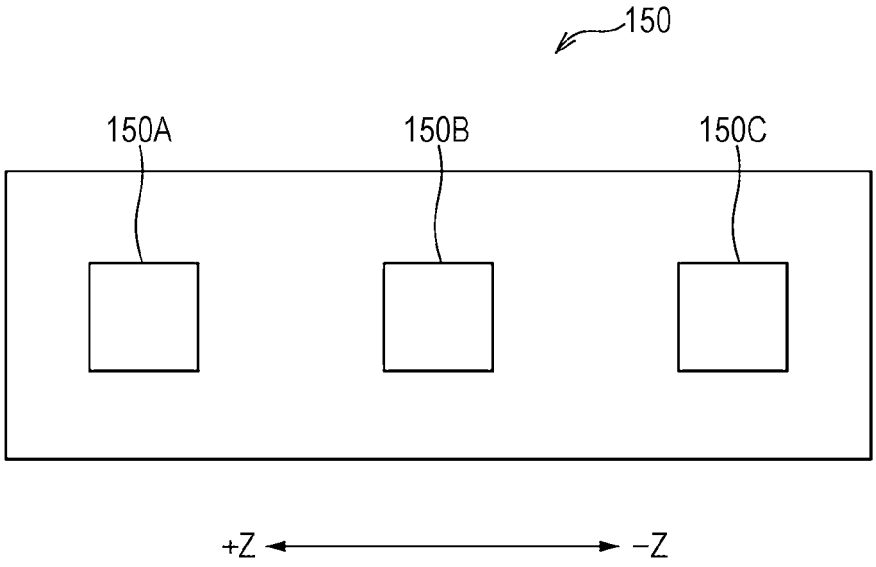
FIG. 6 illustrates the configuration of an optical sensor.

As illustrated in FIG. 6, the optical sensor 150 according to the present exemplary embodiment includes three detection sections, namely a detection section 150A, a detection section 150B, and a detection section 150C, arranged at intervals along the axial direction, in other words the paper width direction.

The first patch images BC1 (see FIG. 5A) for toner supply adjustment, the second patch images BC2 (see FIG. 5B) for concentration adjustment, and the third patch images BC3

Figure 5B:
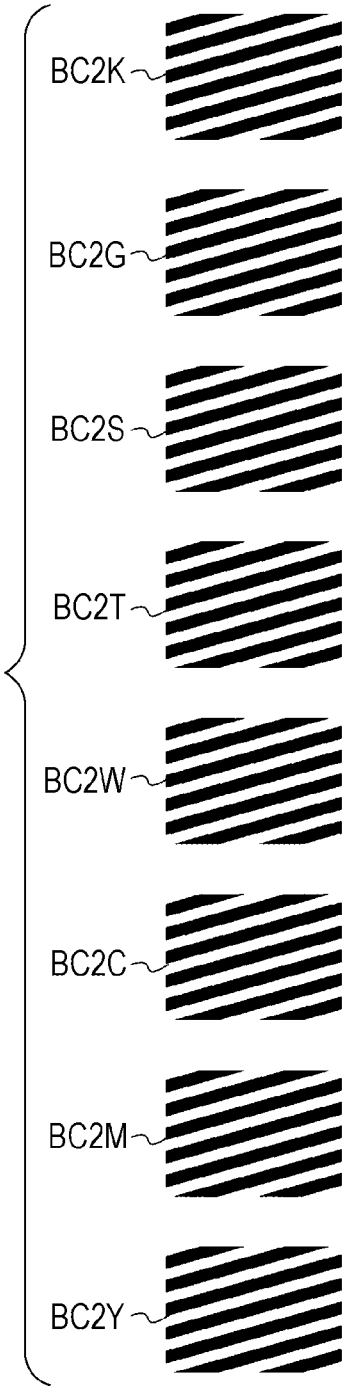
FIG. 5B illustrates second patch images for concentration adjustment.
Figure 5C:
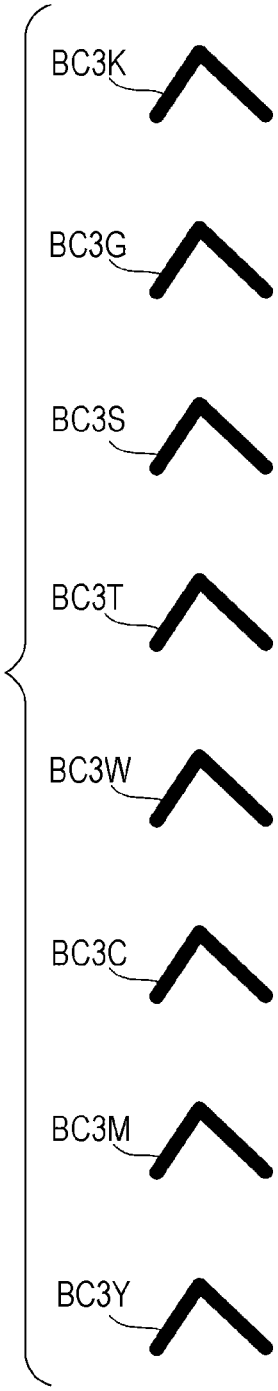
FIG. 5C illustrates third patch images for misregistration adjustment.

(see FIG. 5C) for misregistration adjustment illustrated in FIG. 5 are formed in three rows which correspond to the detection section 150A, the detection section 150B, and the detection section 150C illustrated in FIG. 6 and in which the patch images are arranged in the order of K, G, S, T, W, C, M, and Y.

[Control Device]

Next, a control device 80 that controls operation of the image forming apparatus 10 will be described with reference to FIG. 3.

As illustrated in FIG. 3, the image forming unit 30, the image forming unit 50, a communication section 90, a non-volatile memory 92, the supply device 120, the power source device 159, the optical sensor 150, etc. are electrically connected to the control device 80.

As illustrated in FIG. 3, the control device 80 includes a central processing unit (CPU) 81, a read only memory (ROM) 82, a random access memory (RAM) 83, and an input/output interface (I/O) 84, which are connected to each other via a bus.

The ROM 82 stores an image forming control program (not illustrated) to be executed by the CPU 81. The CPU 81 executes a printing process based on the image forming control program (not illustrated) by loading the image forming control program (not illustrated) from the ROM 82 into the RAM 83.

The image forming unit 30, the image forming unit 50, the communication section 90, and the non-volatile memory 92 are connected to the I/O 84. The communication section 90 is an interface for data communication between a terminal device such as a personal computer (not illustrated) and the image forming apparatus 10. The non-volatile memory 92 stores information that is necessary for the image forming apparatus 10 to execute image forming operation.

The control device 80 performs various types of control for the image forming sections 32 (see FIG. 2 etc.) for the respective colors of the image forming unit 30 to form toner images on the intermediate transfer belt 40 (see FIG. 2 etc.). Similarly, the control device 80 performs various types of control for the image forming sections 52 (see FIG. 2 etc.) for the respective colors of the image forming unit 50 to form toner images on the intermediate transfer belt 60 (see FIG. 2 etc.).

The control device 80 controls developing biases to be applied to the developing rollers 39Y, 39M, 39C, 39W, 59T, 59S, 59G, and 59K (see FIG. 2 etc.) of the developing devices 36 and 56 by the power source device 159. The control device 80 further controls a transfer bias to be applied to the second transfer rollers 24 and 25 (see FIG. 2 etc.) by the power source device 159.

The control device 80 controls the timing, amount, etc. of the toners in the respective colors to be supplied from the toner cartridges 100Y, 100M, 100C, 100W, 110T, 110S, 110G, and 110K (see FIG. 3) to the developing devices 36Y, 36M, 36C, 36W, 56T, 56S, 56G, and 56K (see FIG. 2 etc.) using the supply device 120.

Further, detection values for the patch images BC detected by the optical sensor 150 are input to the control device 80. The timing to form toner images on the intermediate transfer belts 40 and 60 (see FIG. 2 etc.) of the image forming units 30 and 50, specifically the timing etc. of light exposure by the exposure devices 35 and 55 (see FIG. 2 etc.), toner supply by the supply device 120, and the developing biases to be applied to the developing rollers 39 and 59 (see FIG. 2 etc.) by the power source device 159 are controlled on the basis of such detection values.

The various types of control performed on the basis of the detection values for the patch images BC detected by the optical sensor 150 will be discussed in detail later.

[Image Forming Process]

Next, the outline of an image forming process performed by the image forming apparatus 10 will be described.

First, the control device 80 controls the image forming sections 32 such that toner images are formed on the intermediate transfer belt 40 of the image forming unit 30. Similarly, the control device 80 controls the image forming sections 52 such that toner images are formed on the intermediate transfer belt 60 of the image forming unit 50.

Specifically, the control device 80 applies a voltage to the charging members 34 and 54, and causes the charging members 34 and 54, to which a voltage has been applied, to charge the surfaces of the photosensitive bodies 33 and 53 with a potential determined in advance. Subsequently, the control device 80 forms an electrostatic latent image by causing the exposure devices 35 and 55 to radiate light to the surfaces of the photosensitive bodies 33 and 53, which have been charged by the charging members 34 and 54, on the basis of image data acquired via the communication section 90. Consequently, an electrostatic latent image corresponding to the image data is formed on the surfaces of the photosensitive bodies 33 and 53.

Next, the control device 80 causes the developing devices 36 and 56 to develop the electrostatic latent image which is formed by the exposure devices 35 and 55, and visualizes the electrostatic latent image as toner images. Further, the control device 80 causes the first transfer rollers 37 and 57 to transfer the toner images, which are formed on the surfaces of the photosensitive bodies 33 and 53 for the respective colors, as superposed on the intermediate transfer belts 40 and 60.

In this manner, toner images with toners in yellow (Y), magenta (M), cyan (C), and white (W) colors superposed on each other, for example, are formed on the intermediate transfer belt 40 of the image forming unit 30. Similarly, toner images with toners in black (K), gold (G), silver (S), and transparent (T) colors superposed on each other, for example, are formed on the intermediate transfer belt 60 of the image forming unit 50.

The recording paper P, which is fed from the housing section 12 to the transport path 19 by the feed roller 13, is adjusted in transport timing by the resist roller pair 15, and thereafter fed to the second transfer position TJ2 on the transport-direction upstream side on the basis of control by the control device 80. At the second transfer position TJ2, the toner images on the outer peripheral surface of the intermediate transfer belt 40 are transferred to the recording paper P when the recording paper P is transported between the back-up roller 42 and the second transfer roller 24. The recording paper P, to which the toner images have been transferred, is transported toward the transport-direction downstream side to reach the second transfer position TK2 on the transport-direction downstream side.

At this time, the control device 80 adjusts the timing to start image formation such that the toner images which are formed on the intermediate transfer belt 60 of the image forming unit 50 are transferred as superposed on the toner images on the recording paper P, which is transported from the transport-direction upstream side.

The recording paper P, to which the toner images in the respective colors formed by the image forming unit 30 and the image forming unit 50 have been transferred as superposed on each other, is subjected to fixation by the fixing roller pair 16 of the fixing device 18, and thereafter ejected by the transport roller 17 to the ejection section 9, which is provided at the upper portion of the image forming apparatus body 10A.

[Details of Various Types of Control Performed on the Basis of Detection Values for Patch Images Detected by Optical Sensor]

Next, the various types of control performed by the control device 80 on the basis of the detection values for the patch images BC detected by the optical sensor 150 will be discussed in detail.

(Control for Process Control)

First, control for process control will be described. The control for process control according to the present exemplary embodiment is control for the developing biases to be applied to the developing rollers 39 and 59 and control for toner supply to the developing devices 36 and 56.

(Control for Developing Biases)

First, control for the developing biases to be applied to the developing rollers 39Y, 39M, 39C, 39W, 59T, 59S, 59G, and 59K will be described.

The second patch images BC2Y, BC2M, BC2C, and BC2W (see FIG. 5B) for concentration adjustment for Y, M, C, and W are used for control for the developing biases to be applied to the developing rollers 39Y, 39M, 39C, and 39W of the developing devices 36 of the image forming sections 32 for the respective colors on the upstream side.

Similarly, the second patch images BC2T, BC2S, BC2G, and BC2K (see FIG. 5B) for concentration adjustment for T, S, G, and K are used for control for the developing biases to be applied to the developing rollers 59T, 59S, 59G, and 59K of the image forming sections 52 of the image forming unit 50 on the downstream side.

The control device 80 adjusts the developing biases for the developing rollers 39Y, 39M, 39C, 39W, 59T, 59S, 59G, and 59K on the basis of detection values for the second patch images BC2Y, BC2M, BC2C, BC2W, BC2T, BC2S, BC2G, and BC2K detected by the optical sensor 150. Specifically, the control device 80 adjusts the developing biases for the developing rollers 39Y, 39M, 39C, 39W, 59T, 59S, 59G, and 59K on the basis of detection values for the second patch images BC2 such that the image density is a reference density determined in advance.

(Control for Toner Supply)

Next, control for the toners to be supplied to the developing devices 36Y, 36M, 36C, 36W, 56T, 56S, 56G, and 56K will be described.

The first patch images BC1Y, BC1M, BC1C, and BC1W (see FIG. 5B) for toner supply adjustment for Y, M, C, and W are used for control for toner supply to the developing devices 36Y, 36M, 36C, and 36W of the image forming sections 32 of the image forming unit 30 on the upstream side.

Similarly, the first patch images BC1T, BC1S, BC1G, and BC1K (see FIG. 5B) for toner supply adjustment for T, S, G, and K are used for control for toner supply to the developing devices 56T, 56S, 56G, and 56K of the image forming sections 52 for the respective colors of the image forming unit 50 on the downstream side.

The amounts of the toners to be supplied to the developing devices 36Y, 36M, 36C, 36W, 56T, 56S, 56G, and 56K are adjusted on the basis of detection values for the first patch images BC1Y, BC1M, BC1C, BC1W, BC1T, BC1S, BC1G, and BC1K detected by the optical sensor 150. Specifically, amounts of toners determined in advance are supplied to the developing devices 36Y, 36M, 36C, 36W, 56T, 56S, 56G, and 56K in accordance with detection values for the first patch images BC1 in the case where such detection values are smaller than a reference value determined in advance.

[Adjustment of Misregistration]

Next, adjustment of misregistration, or so-called color registration control, in the sub scanning direction of an image obtained by superposing the toner images in Y, M, C, W, T, S, G, and K colors which are formed by the image forming sections 32 of the image forming unit 30 and the image forming sections 52 of the image forming unit 50 will be described. In the present exemplary embodiment, the color registration control is performed at the timing of light exposure by the exposure devices 35 and 55.

Specifically, the third patch images BC3Y, BC3M, BC3C, BC3W, BC3T, BC3S, BC3G, and BC3K for misregistration adjustment illustrated in FIG. 5B are detected by the optical sensor 150, and the timing of light exposure by the exposure devices 35Y, 35M, 35C, 35W, 55T, 55S, 55G, and 55K is adjusted such that the third patch images are at a position determined in advance.

In the present exemplary embodiment, it is necessary to perform misregistration adjustment between the entire image forming unit 30 and the entire image forming unit 50, in addition to misregistration adjustment among the image forming sections 32 of the image forming unit 30 and misregistration adjustment among the image forming sections 52 of the image forming unit 50.

Misregistration may be adjusted by any method. In the present exemplary embodiment, however, misregistration is adjusted as follows.

In the present exemplary embodiment, a rough adjustment sequence is first performed, and thereafter a fine adjustment sequence is performed. The rough adjustment sequence is performed only when the image forming apparatus 10 is installed, maintained, turned on, etc. The fine adjustment sequence is performed, as appropriate, at a timing determined in advance.

In the rough adjustment sequence according to the present exemplary embodiment, the third patch images BC3Y, BC3M, BC3C, BC3W, BC3T, BC3S, BC3G, and BC3K are detected by the optical sensor 150, and misregistration of all the image forming sections 32Y, 32M, 32C, 32W, 52T, 52S, 52G, and 52K from an ideal or absolute reference timing is corrected.

In the fine adjustment sequence according to the present exemplary embodiment, misregistration between the entire image forming unit 30 and the image forming unit 50 is first adjusted, and thereafter misregistration among the image forming sections 32 for the respective colors of the image forming unit 30 is adjusted and misregistration among the image forming sections 52 for the respective colors of the image forming unit 50 is adjusted.

In the misregistration adjustment between the entire image forming unit 30 and the image forming unit 50 in the fine adjustment sequence according to the present exemplary embodiment, the optical sensor 150 detects the third patch image BC3 which is formed by the image forming section 32 for a reference color determined in advance of the image forming unit 30, e.g. the third patch image BC3W which is formed by the image forming section 32W, and the third patch image BC3 which is formed by the image forming section 52 for a reference color determined in advance of the image forming unit 50, e.g. the third patch image BC3K which is formed by the image forming section 52K, and adjustment is performed such that the third patch image BC3W and the third patch image BC3K are at positions determined in advance and in a positional relationship determined in advance.

Figure 7:
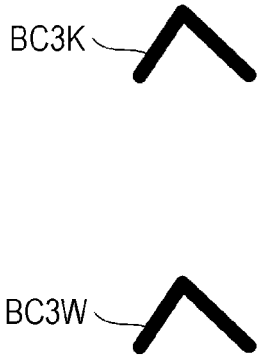
FIG. 7 illustrates a different formation example of the third patch images.

At this time, only the third patch image BC3W and the third patch image BC3K may be formed. As illustrated in FIG. 7, only the third patch image BC3W and the third patch image BC3K may be formed at a reduced distance from each other.

Next, as discussed earlier, misregistration among the image forming sections 32 for the respective colors of the image forming unit 30 is adjusted, and misregistration among the image forming sections 52 for the respective colors of the image forming unit 50 is adjusted. The third patch images BC3 in all the colors may be formed at all times. Alternatively, only the third patch images BC3Y, BC3M, BC3C, and BC3W may be formed when misregistration is adjusted for only the image forming unit 30, and only the third patch images BC3T, BC3G, BC3S, and BC3K may be formed when misregistration is adjusted for only the image forming unit 50.

In the misregistration adjustment among the image forming sections 32 for the respective colors of the image forming unit 30 in the fine adjustment sequence according to the present exemplary embodiment, the optical sensor 150 detects the third patch image BC3W which is formed by the image forming section 32W which serves as the reference of the image forming unit 30 and the third patch images BC3Y, BC3M, and BC3C which are formed by the other image forming sections 32Y, 32M, and 32C, and adjustment is performed such that the third patch images BC3Y, BC3M, and BC3C are in a positional relationship determined in advance with respect to the third patch image BC3W.

In the misregistration adjustment among the image forming sections 52 for the respective colors of the image forming unit 50 in the fine adjustment sequence according to the present exemplary embodiment, similarly, the optical sensor 150 detects the third patch image BC3K which is formed by the image forming section 52K which serves as the reference of the image forming unit 50 and the third patch images BC3T, BC3S, and BC3G which are formed by the other image forming sections 52T, 52S, and 52G, and adjustment is performed such that the third patch images BC3T, BC3S, and BC3G are in a positional relationship determined in advance with respect to the third patch image BC3K.

The image forming section 32W which serves as the reference of the image forming unit 30 and the image forming section 52K which serves as the reference of the image forming unit 50 are at the same ordinal number of position as counted toward the upstream side from the second transfer positions TJ2 and TK2, respectively. In the present exemplary embodiment, the image forming sections 32W and 52K are the first from the second transfer positions TJ2 and TK2, respectively.

Different Examples of Adjustment of Misregistration

Next, different examples of the adjustment of misregistration will be described.

In the fine adjustment sequence, misregistration adjustment is performed using the image forming section 32W as the reference of the image forming unit 30 and using the image forming section 52K as the reference of the image forming unit 50. However, the present disclosure is not limited thereto.

For example, all the third patch images BC3Y, BC3M, BC3C, BC3W, BC3T, BC3S, BC3G, and BC3K may be formed, and misregistration adjustment may be performed collectively for all the image forming sections 32Y, 32M, 32C, 32W, 52T, 52S, 52G, and 52K, rather than providing image forming sections that serve as the references.

The number of colors of the third patch images BC3 for one image forming unit may be smaller than that for the other image forming unit, for example. In this case, the number of colors of the third patch images BC3 for an image forming unit that is more frequently subjected to misregistration adjustment may be smaller than that for an image forming unit that is less frequently subjected to misregistration adjustment. The image forming unit that is more frequently subjected to misregistration adjustment may be specified through a comparison of the number of times of misregistration adjustment performed for image forming sections in a period etc. determined in advance, for example.

For example, third patch images in three colors, namely BC3Y, BC3M, and BC3C, may be formed for the image forming unit 30, and third patch images for two colors, namely BC3K and BC3S, may be formed for the image forming unit 50. In this case, misregistration adjustment between the entire image forming unit 30 and the entire image forming unit 50 may be performed using one third patch image of each of the image forming unit 30 and the image forming unit 50, e.g. the third patch image BC3C and the third patch image BC3K.

Alternatively, misregistration adjustment may be performed for only image forming sections 32 and 52 that form toner images to be transferred to the recording paper P through the second transfer immediately before the misregistration adjustment is performed, for example. For example, misregistration adjustment may be performed for only the image forming sections 32Y, 32M, 32C, and 52K in the case where images are formed using the image forming sections 32Y, 32M, 32C, and 52K immediately before the misregistration adjustment is performed.

<Others>

The present disclosure is not limited to the exemplary embodiment described above.

For example, in the exemplary embodiment described above, only the optical sensor 150, which detects the patch images BC which have been transferred to the transport belt 21 through the second transfer, is provided in the vicinity of the upper end portion of the transport belt 21. However, the present disclosure is not limited thereto. An optical sensor may be provided also at a different location. For example, a detection device for misregistration adjustment may be installed at only one location, and a detection device for process control may be installed at a plurality of locations.

In the exemplary embodiment described above, for example, the image forming apparatus 10 includes two image forming units, namely the image forming unit 30 and the image forming unit 50. However, the present disclosure is not limited thereto. The image forming apparatus may include three or more image forming units. The image forming units 30 and 50 each include four image forming sections 32 and 52. However, the present disclosure is not limited thereto. It is only necessary that the image forming units should each include two or more image forming sections.

The optical sensor 150 which serves as an example of the detection device detects the patch images BC which have been transferred to the transport belt through the second transfer. However, the present disclosure is not limited thereto. The optical sensor 150 may detect the patch images BC which have been transferred to the recording paper P which serves as an example of the recording medium through the second transfer.

The configuration of the image forming apparatus is not limited to the configuration according to the exemplary embodiment described above, and may be modified in various ways. The image forming apparatus may be implemented in various aspects without departing from the scope and spirit of the present disclosure.

What is claimed is:

1. An image forming apparatus comprising:

a first plurality of image forming sections that form a first toner image for transfer to a first medium;

a second plurality of image forming sections that form a second toner image for transfer to a second medium;

a transfer medium upon which the first toner image transferred to the first medium and the second toner image transferred to the second medium are transferred; and a detection device configured to detect a misregistration between the first toner image transferred to the transfer medium and the second toner image transferred to the transfer medium.

2. The image forming apparatus of claim 1, wherein the first toner image transferred to the transfer medium and the second toner image transferred to the transfer medium form a patch image and the detection device detects the misregistration based on detecting the patch image.

* * * * *